US006095625A

United States Patent [19]

Harris et al.

[11] Patent Number: 6,095,625

[45] Date of Patent: Aug. 1, 2000

[54] VERTICAL CARD FILE

[75] Inventors: David C. Harris, Baraboo; Mark S. Koehneke, Milwaukee, both of Wis.; John M. Fuller, Vacaville, Calif.; Jonathan P. Van Dore, Minneapolis, Minn.; Jeff E. Schiedegger, Lapeer, Mich.

[73] Assignee: Berol Corporation, Bellwood, Ill.

[21] Appl. No.: 09/191,680

[22] Filed: Nov. 13, 1998

[51] Int. Cl.[7] ..... A47B 97/00

[52] U.S. Cl. ..... 312/274; 312/183; 312/193; 206/45.23; 206/754; 40/391; 40/404; 40/725

[58] Field of Search ..... 312/273, 274, 312/183, 193, 311, 270.2, 272, 270.5, 902; 40/373, 391, 393, 404, 725, 728; 206/45.2, 45.23, 45.24, 751, 754

[56] References Cited

U.S. PATENT DOCUMENTS

| | | | |
|---|---|---|---|
| D. 227,309 | 6/1973 | Laughlin . | |
| 274,604 | 3/1883 | Hoffman . | |
| 371,182 | 10/1887 | Evans | 206/754 |
| 868,118 | 10/1907 | Pardee . | |
| 964,242 | 7/1910 | Greenawalt . | |
| 1,104,711 | 7/1914 | Shepard . | |
| 1,471,481 | 10/1923 | Gobberdiel | 40/537 X |
| 1,795,699 | 3/1931 | Auerbach . | |
| 1,850,887 | 3/1932 | Laumonier | 206/45.23 |
| 2,399,470 | 4/1946 | Crane | 312/327 X |
| 2,665,808 | 1/1954 | McAlister | 312/183 X |
| 2,681,201 | 6/1954 | Grunwald | 312/902 X |
| 2,775,342 | 12/1956 | Smith | 206/755 X |
| 2,875,010 | 2/1959 | Sola et al. . | |
| 3,246,940 | 4/1966 | Karper . | |
| 3,326,615 | 6/1967 | Karper | 312/183 |
| 3,352,614 | 11/1967 | Andersen | 312/327 X |
| 3,360,116 | 12/1967 | Somers et al. | 220/334 |
| 3,816,949 | 6/1974 | Laughlin . | |
| 3,985,409 | 10/1976 | Kneier | 312/902 X |
| 4,006,821 | 2/1977 | Sautter | 312/902 X |
| 4,085,987 | 4/1978 | Vartdal | 312/902 X |
| 4,222,190 | 9/1980 | Solomon | 40/530 |
| 4,356,918 | 11/1982 | Kahle et al. | 206/444 |
| 4,467,540 | 8/1984 | Gfesser, Jr. | 40/728 |
| 4,478,335 | 10/1984 | Long et al. | 206/45.23 X |
| 4,660,719 | 4/1987 | Peterson et al. | 206/754 X |
| 4,676,375 | 6/1987 | Willems et al. | 206/45.23 X |
| 4,906,057 | 3/1990 | Davi et al. | 312/193 |
| 4,934,530 | 6/1990 | Riess | 312/902 X |
| 5,205,625 | 4/1993 | Koch | 312/193 X |
| 5,893,457 | 4/1999 | Wei | 312/902 X |

*Primary Examiner*—Peter M. Cuomo
*Assistant Examiner*—James O. Hansen
*Attorney, Agent, or Firm*—Foley & Lardner

[57] ABSTRACT

A file for storing and displaying cards is disclosed. The card file consists of a base, a cover, and a tray, the cover being pivotally attached to the base and the tray being slidably disposed with respect to the cover and pivotally coupled to the base. The tray is attached to the base in such a way that when the cover is opened, the tray pivots downwardly, thereby presenting the cards at an angle. The weight of the address cards keeps the device in either the open or closed orientation chosen by the user. The card file in accordance with the present invention can be suitably adapted to display a picture or time keeping instrument in the face of the cover, so that when the cards are concealed, the card file serves as an office accessory.

7 Claims, 6 Drawing Sheets

VERTICAL CARD FILE

FIELD OF THE INVENTION

The present invention relates to storage devices, and more specifically, in the preferred form, to storage devices vertically oriented and suitable for holding and displaying a plurality of organizer cards. In its most preferred form, the file serves the additional function of displaying photographs or other decorative items.

BACKGROUND OF THE INVENTION

In recent years, the demand for developing contacts has increased and as a result individuals have had to find creative ways to store names, addresses and other information without cluttering their offices. The key balance is between access to contact information and the efficient use of limited desk space. A wide variety of other information may also need to be organized, e.g. recipes, notes, etc.

As the demand for capacity has increased, non-electronic storage devices in general, and organizer card holders in particular, have become substantially larger. With this increased size comes greater competition for available desk space. In response to these concerns, storage devices have been developed that extend vertically in order to reduce the need for encroachment on limited desk space.

Attempts to address the space limitation problem have resulted in development of a multiplicity of storage devices. Some of these storage devices provide for the efficient storage of printed material, but frequently present new space considerations of their own.

Historically, three fundamental design issues impact the storage device art. Storage devices need to be functionally designed to have a large storage capacity, to provide easy access and to be durable. To have a large storage capacity and be durable, many currently available storage devices are bulky and are made from heavy materials. See U.S. Pat. No. 274,604 to Hoppman, U.S. Pat. No. 868,118 to Pardee, and U.S. Pat. No. 4,222,190 to Solomon.

Other devices provide multiple compartments in an attempt to address the storage capacity problem. See U.S. Pat. No. 2,875,010 to Sola et al., and U.S. Pat. Nos. 3,246,940 and 3,326,615 to Karper. Others have even attempted to maximize the utility of multi-compartment storage devices by adapting them to have a single compartment, i.e. U.S. Pat. No. 1,104,711 to Shepard. Others have attempted to address the space limitation problem by using wall mounted structures. See U.S. Pat. No. 3,352,614 to Anderson. However, the aforementioned devices failed to afford the user easy access to the storage contents.

In an attempt to address this concern, devices were developed that gave the user easy access, but compromised durability and storage capacity. See U.S. Pat. No. 2,399,470 to Crane, U.S. Pat. No. 1,795,699 to Aurbach and U.S. Pat. No. 3,816,949 and U.S. Pat. No. Des. 227,309 to Laughlin. All of these devices are further limited by wear of the movable parts which results in diminished functionality over time. An attempt to address this problem resulted in devices that require a weight or fastening means to ensure that the device remains in an operable or inoperable position desired by the user. See U.S. Pat. No. 1,471,481 to Gobberdiel and U.S. Pat. No. 964,242 to Greenawalt.

None of these different iterations suggest a storage device that is well suited to (1) receive and display organizer cards horizontally in a removable tray, (2) store the cards vertically, and (3) economize on desk space by adapting the device to serve multiple functions.

There is a need for a storage device, particularly an organizer card file that is constructed in such a manner that the above objectives are achieved. There is additionally a need for a storage device that can be used to display its stored contents, and which is, at other times, capable of concealing its contents. A further need exists for a card file that is adaptable to display pictures or a clock or other decorative items when the stored contents are concealed. Yet another need exists for a card holder having a plate that holds the organizer card tray in place when the card file is in its closed position.

SUMMARY OF THE INVENTION

It therefore is an object of the present invention to provide a device for the storage and display of a plurality of organizer cards, such as contact cards.

It is another objective of the present invention to provide a vertical card file which holds cards and in which the cards can either be exposed for easy access or concealed by pivoting an external surface of the device. When the cards are concealed, the vertical card file in accordance with the present invention serves as an attractive piece of furniture that may be integrated into any decor and which may also display pictures or a clock or other decorative material.

In accomplishing these and other objectives, there is provided, in accordance with one aspect of the present invention, a vertical card file which may be further adapted to include one or more pictures on an external surface of the device, so that when the device is pivoted such that the cards are concealed, the device serves as a piece of integrated furniture capable of displaying one or more visual images. Alternatively, the vertical card file may be adapted to include a time keeping instrument, such as an analog or digital clock disposed on an external face thereof.

The present invention achieves the above objectives in each of several embodiments. Various embodiments of the present invention allow for the display of differing numbers of visual images as well as providing different amounts of storage capacity. In a preferred embodiment, there is preferably one picture frame per card file. Such frames may be of equal or varying sizes and shapes e.g., rectangular, oval, circular, square, etc.

In a preferred embodiment, the cover, tray and base are constructed from plastic, and rails are provided for releasably holding the cards and are made from the same plastic. Alternatively, a rigid metal or metal alloy which may or may not be painted to complement the color and texture of the tray may be used for the rails. Alternatively, the cover, and base, or the whole vertical card file may be fashioned from other suitable materials such as metal, wood, or polymeric materials. A vertical card file according to the present invention can be constructed from a single type of material. The flexibility of choice of construction provides the needed adaptability to accent the innumerable tastes and design preferences of consumers.

Further objects, features and advantages of the invention will be apparent from the following detailed description taken in conjunction with the accompanying drawings.

DETAILED DESCRIPTION OF THE INVENTION

Figure 1:
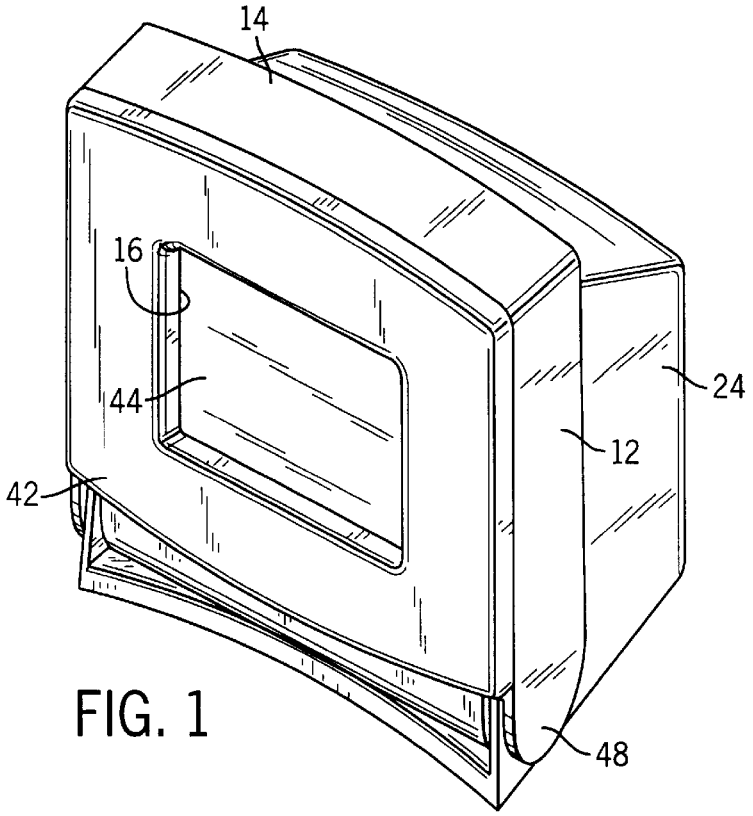
FIG. 1 is a perspective view of an exemplary embodiment of a closed vertical card file in accordance with the present invention, without a bumper.
Figure 3:
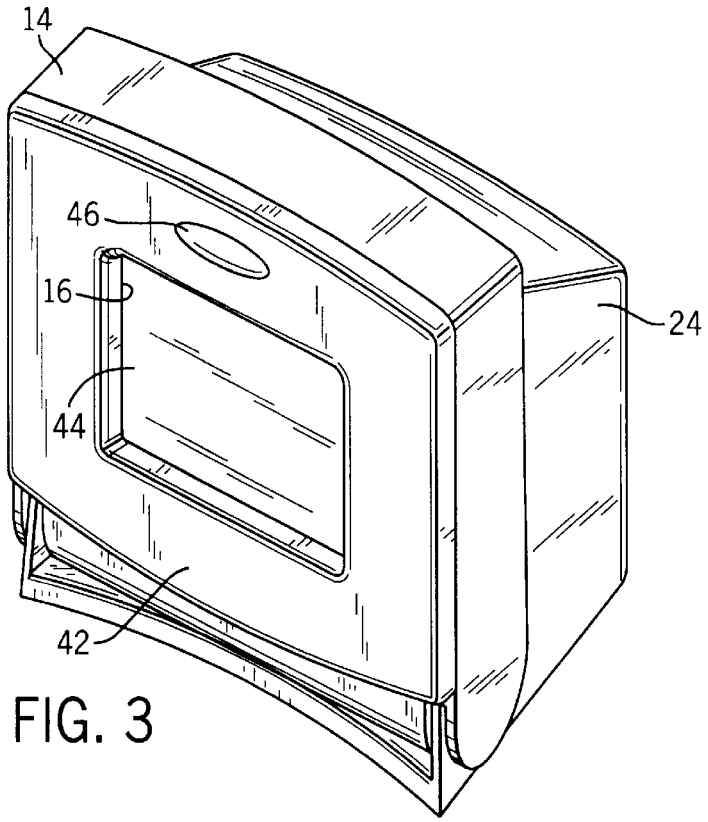
FIG. 3 is a perspective view of an alternate embodiment of a closed vertical card file in accordance with the present invention with a bumper.
Figure 2:
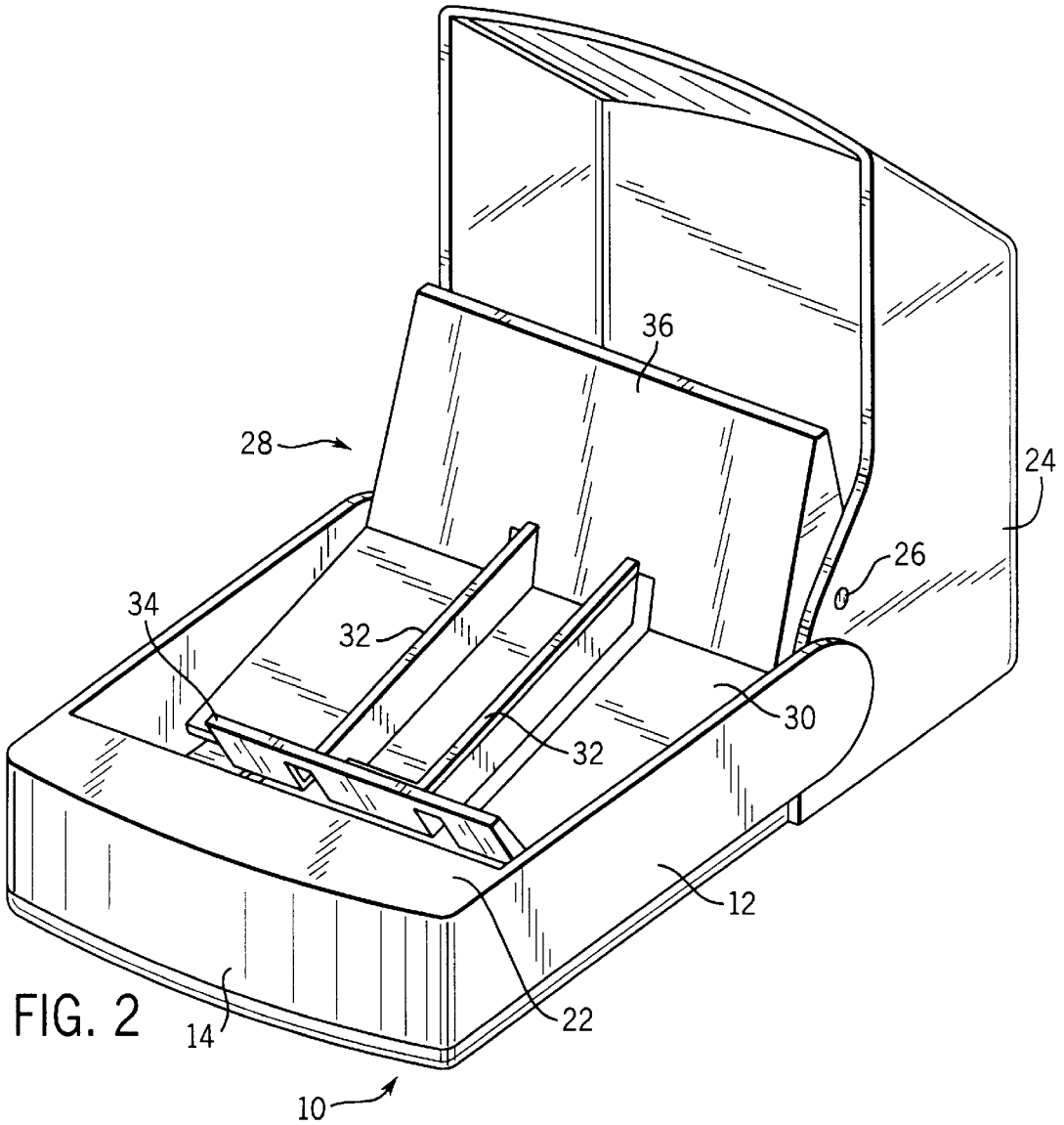
FIG. 2 is a perspective view of the exemplary vertical card file of FIG. 1, with the vertical card file in an open position.
Figure 4:
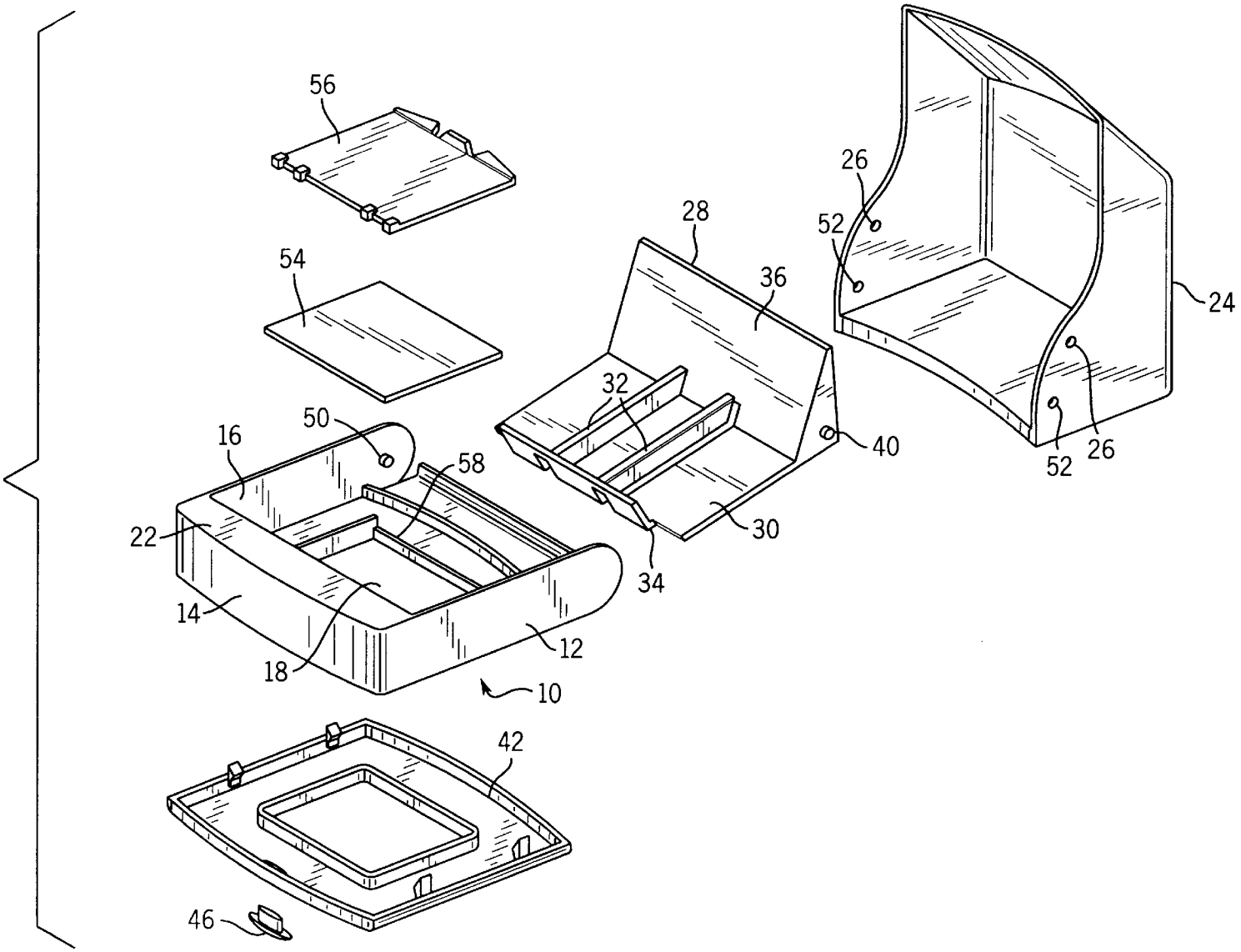
FIG. 4 shows an exploded view of the exemplary components of the FIG. 1 file.

With reference to the drawings, wherein like reference numerals refer to like parts in each of the several views, a vertical card file in accordance with the most preferred form and an alternate embodiment of the present invention are shown generally in FIGS. 1–8. The vertical card file comprises a cover 10, a base 24, and a tray 28, as best shown in FIGS. 2 and 4. In the preferred embodiment, shown in FIG. 1, the cover 10 comprises side portions 12, 14 and 16 and face portion 18, where the side portions 12–16 are perpendicular to the face portion 18 and at right angles with respect to one another. The side portions 12–16 are also attached to each other along a side thereof to form edges. The tray 28 is slidably received in the cover 10 and is pivotally attached to the base 24 (in a manner to be described later), such that when cover 10 is opened, tray 28 correspondingly pivots, thereby presenting the organizer cards (not shown) to the user. The pivotal connection between the cover 10 and the base 24, as well as the tray 28 and the base 24, may be implemented in any conventional manner, such as by use of bearings, pin and socket couplings, rotating axles and the like.

The vertical card file in accordance with the present invention may further include a bezel 42 that is placed against and which substantially covers the face portion 18 of the cover 10. For additional protection, at least one bumper 46 may be provided on the face portion 18 of the cover 10 or may be optionally affixed to the bezel 42. In either of these alternative embodiments, the bumper 46 protects the cover 10 when the vertical card file is opened to the position shown in FIG. 2. The cover 10 preferably also includes a plate 22 which is attached to the side portion 14, and extends between side portions 12 and 16 such that the tray 28 may slide underneath plate 22 when the vertical card file is in the closed orientation. The plate 22 is parallel to but spaced apart from the cover face 18 and assists in preventing the cover 10 from inadvertently falling into the open position.

Focusing attention now primarily on FIG. 2, the tray 28 comprises an interior surface 30, at least one longitudinally extending rail 32, a front surface 34, and an extended back surface 36. Rails 32 extend along the interior surface 30 and communicate with the front surface 34 and the extended back surface 36 in such a manner suitable for retaining and displaying organizer cards. Additionally, the front surface 34 and the extended back surface 36 can be affixed to the interior surface 30 in a sloped manner which is suitable for presenting the cards at an angle for easier visibility. This slope also serves the additional function of aligning the cards in such a manner that when the vertical card holder is in the close orientation the center of gravity insures that the cards lay back and orients the tray 28 vertically. The vertical card file, in a preferred embodiment, may be adapted such that the tray 28 includes rails 32 extending between the front surface 34 and back surface 36 configured for displaying a plurality address cards wherein the front surface 34 and back surface 36 are at an angle such that the back surface 36 is elevated with respect to the front surface 34 allowing the cards to recline backward toward the elevated back surface 36. In embodiments where more than one longitudinally extending rail 32 is provided, the rails 32 are parallel with respect to one another.

Figure 9:
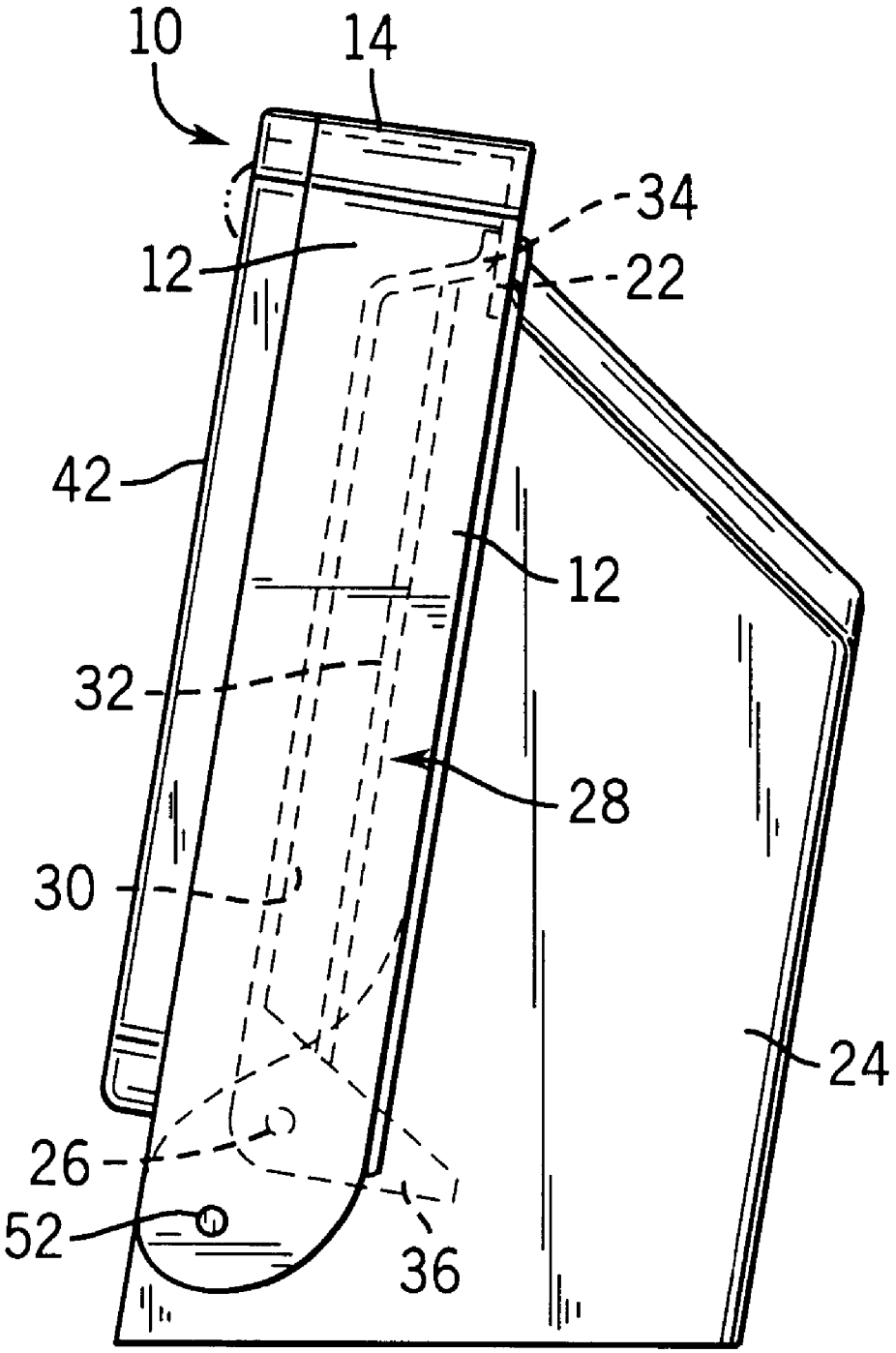
FIG. 9 is a side sectional view showing how the tray is disposed within the cavity of the cover of an exemplary embodiment of a vertical card file in accordance with the present invention in the closed orientation.

It should be noted that no mechanical fastening means are necessary to keep the vertical card file in its closed orientation. The cover 10 remains closed from the gravitational pull on the cards thereby preventing the vertical card file from returning to its open position. Additionally, plate 22 holds tray 28 when the vertical card file is in the closed orientation. FIG. 9 shows a cross section of the closed vertical card file in accordance with the present invention. A cavity 20 between plate 22 and face portion 18 is formed by cover 10 such that front surface 34 of tray 28 is disposed within the cavity 20 between plate 22 and face portion 18 when the vertical card file is in the closed orientation. As a result of the differential in rotational coupling of the cover 10 and the tray 28 to the base 24, when the cover is elevated from the open orientation to the closed orientation, the cover and the tray pivot unequally, causing the tray 28 to slide upward and the front surface 34 thereof slides under the plate 22 and into the cavity 20 of the cover 10. Since the cover 10 and the tray 28 have fixed pivot points, when the cover 10 is pivoted from the open to the closed position the tray 28 slides ahead and toward the side portion 14 of the cover and ultimately fits within the cavity 20 of the cover 10 locking the vertical card file in the closed position.

Due to this predetermined differential between the pivot points of the cover 10 and the tray 28 with respect to the base 24, the front surface 34 of tray 28 is trapped within the cavity 20 of the cover 10. One the tray 28 is in the closed position, see FIG. 6, the center of gravity is such that the tray 28 remains in place. Since the front surface 34 of tray 28 is trapped within the cavity 20 of the cover 10, the cover 10 is biased in the closed position by the weight of the tray 28. Further, the center of gravity of the cards also act to bias the tray 28 and cover 10 to the closed position. As a result, when the vertical card file is in the closed position, the tray 28 is trapped and therefore stored within the interior portion 58 of the cover 10. Alternatively, it is possible to secure the tray 28 and cover 10 to the base 24 in the closed position by a conventional fastening means, such as a lock, latch, etc.

Figure 6:
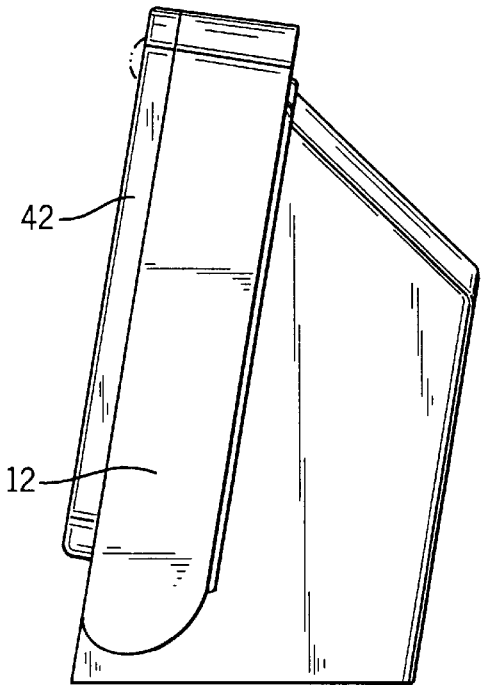
FIG. 6 is a side elevation view of an exemplary embodiment of a closed vertical card file in accordance with the present invention.
Figure 7:
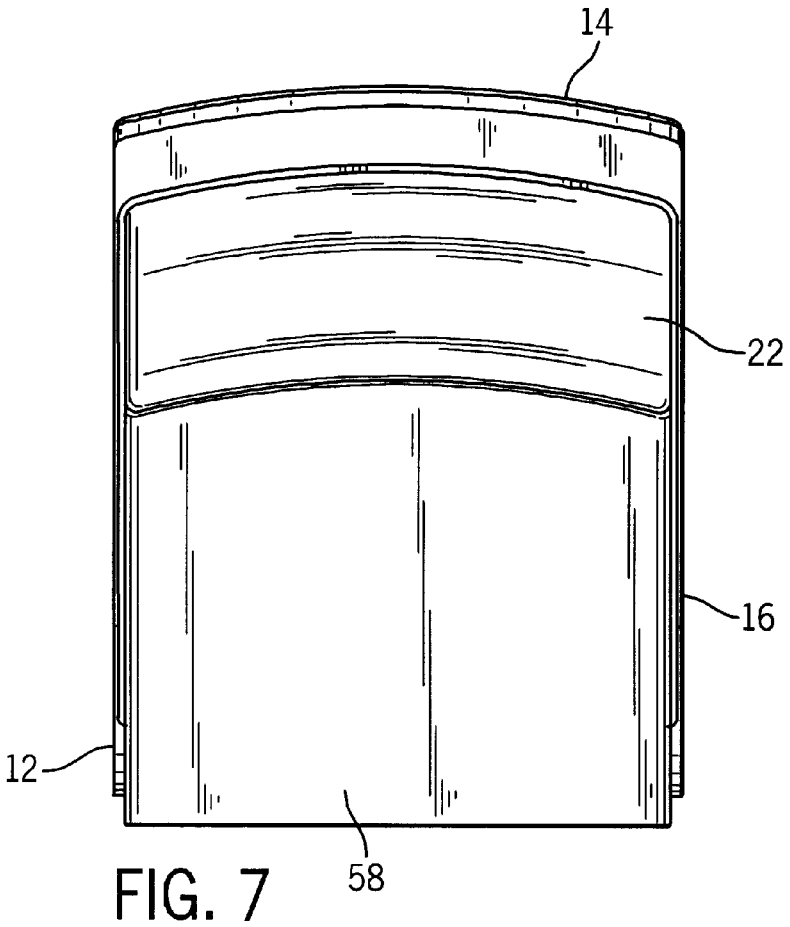
FIG. 7 is a top plan view of an exemplary embodiment of the closed vertical card file in accordance with the present invention.
Figure 8:
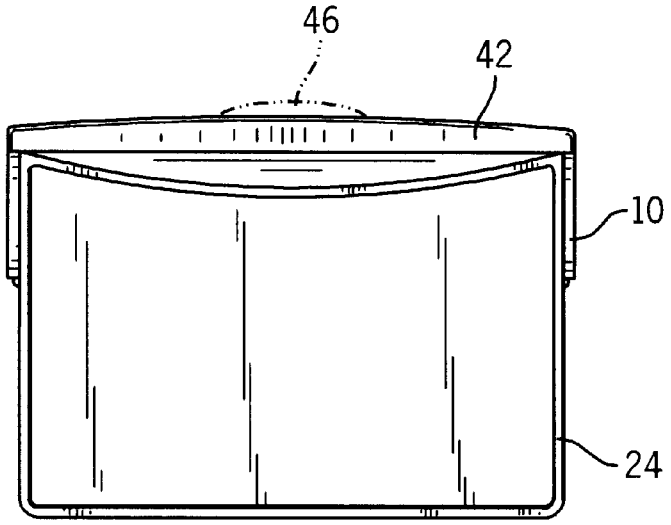
FIG. 8 is a bottom plan view of the exemplary embodiment of FIG. 6.

A vertical card file according to the present invention can be modified such that the base of the vertical card file sits flush on the display surface. As shown in FIGS. 6 and 8, the base 24 may alternatively be adapted to sit at an angle. The vertical card file in accordance with the present invention may be further adapted to include one or more feet affixed to the base 24 so that the tilting angle may be exaggerated or diminished.

A vertical card file according to the present invention can be further adapted such that cover 10, the base 24 or both, further include one or a plurality of aperture(s) 44, adapted for display of decorative articles such as pictures or time pieces. In the preferred embodiment, the cover 10 is adapted to receive and display a single visual image such as a photograph. Alternatively, the cover 10 or the base 24 may be adapted to receive multiple visual images such as photographs on the various surfaces thereof. The visual images are held in place by a planar picture protector 54 (made for example, from corrugated paperboard) which fits within aperture 44 and is disposed behind the visual image. Additionally, a door 56 may be provided which can be pivotally attached to the cover 10 to prevent the visual image from being dislocated from the aperture 44. The door 56 is connected to the cover 10 by a hinge or other conventional mechanism. Aperture 44 through which visual images may be viewed may also include a pane of glass in front of the visual image. The frame back 54 may be removable or alternatively attached to the cover 10 such that the user must slide the visual images between the frame back 54 and the optional pane of glass. In a preferred embodiment, the visual image is disposed between glass and the hinged door 56.

While one rectangular opening is shown in the FIGURES, the number and shapes thereof may be widely varied by using larger or smaller openings or by changing the shape of the openings to include any mix of rectangular, square, oval, round or other shaped openings.

FIG. 4 shows pins on the tray 28 and apertures 26 on either side of the base 24 to provide a pivoting connection. FIG. 4 also shows apertures 52 on either side of the base 24 for pivotally connecting with the pins 50 on side portions 12 and 16 of cover 10.

Figure 5:
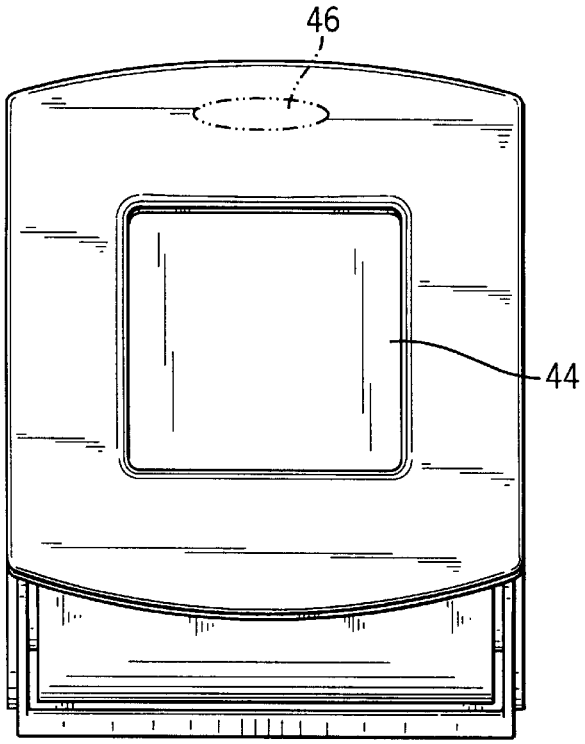
FIG. 5 is a front elevation view of an exemplary embodiment of a closed vertical card file in accordance with the present invention.

Referring now to FIG. 5, a vertical card file adapted to display a single visual image, e.g. a photograph is shown. However, alternative embodiments of a vertical card file in accordance with the present invention may or may not be adapted to receive such visual images. Cover 10 may be adapted to display a time keeping instrument, such as an analog or digital clock, instead of a photograph.

Additionally, the cover 10 and the tray 28 may be fashioned from a single piece of material such that cover 10 and the tray 28 are a cooperative whole.

The following discussion of use is by way of illustration and is not to be construed as limiting.

The user grabs the upper portion of the cover 10 by either the top or the sides and pulls forward and down to open the card file. The cover 10 pivots down and comes to a stop on the table. A bumper 46 on the front of the bezel 42, if used, prevents damage to the cover 10 or table top. As the cover 10 is opened, the tray 28 to which the cards are attached, also pivots. The tray is attached to the base in such a manner that when the cover is opened, the tray slides forward presenting the cards preferably at an angle which is higher in the back. This angled orientation allows for easier reading and easier flipping through the cards.

Once the user finishes retrieving information from the cards, he or she grabs the cover 10 and pivots it to the closed position, whereafter the cover 10 will remain closed from the weight of the cards in the tray 28.

Four round rubber feet may be placed on the bottom of the base 24 which help to prevent scratching the table. In addition, these feet help prevent the product from sliding when being used. Yet another function of the feet is that the feet may be adjustable so that the vertical card file can sit at an angle determined by the user.

Since the vertical card file in accordance with the present invention may be adapted to receive visual images or a time keeping instrument, the pivoting cover 10 affords easy access for removing the visual image or changing the battery on the time keeping instrument. To change the picture, one opens the cover 10 and lifts up on the tray 28 and pivots it back to a vertical position. This gives complete access to the hinged door 56. To open the door 56, the latch (not shown) is compressed and the door 56 is pivoted open. After changing the picture or the battery, the door 56 is simply shut and it latches in the closed position.

The features disclosed in the present description and claims, both separately and in combination thereof, are material for realizing this invention and diverse forms thereof. The present invention may be embodied in other specific forms without departing from its spirit or its central characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed is:

1. A vertical card file, comprising:

a base including a bottom portion for supporting the base on a horizontal surface;

a cover pivotally attached to the base for movement of the cover from a closed position to an open position while the bottom of the base supports the base on a horizontal surface, the cover having a face portion, and side portions perpendicular to the face portion, the face portion being in a generally vertical orientation in the closed position and being generally horizontal in the open position; and a tray pivotally attached to the base and slidably disposed within the cover, the tray comprising one or more longitudinally extending rails, the tray being accessible when the cover is in the open position, and being inaccessible when the cover in the closed position, wherein the longitudinally extending rails are configured for displaying a plurality of cards wherein a front surface and a rear surface of the tray are at an angle such that the rear surface is elevated with respect to the front surface allowing the cards to recline backward toward the elevated rear surface.

2. The vertical card file of claim 1, wherein the cover further comprises a bezel on the face portion of the cover.

3. The vertical card file of claim 2, wherein the bezel further comprises at least one bumper extending from a front surface of the bezel.

4. The vertical card file of claim 1, wherein the cover further comprises a plate adapted to retain the tray when the cover is in the closed position.

5. The vertical card file of claim 1, wherein the cover further includes an aperture for displaying photographic images.

6. The vertical card file of claim 1, wherein the cover further comprises a time keeping means displayed on the face portion of the cover.

7. The vertical card file of claim 1, wherein the longitudinally extending rails are arranged for releasably receiving cards thereon.

* * * * *